US006896333B1

(12) United States Patent
Matern et al.

(10) Patent No.: US 6,896,333 B1
(45) Date of Patent: May 24, 2005

(54) HEIGHT-ADJUSTMENT MECHANISM FOR AN ARMREST

(75) Inventors: Gerard J. Matern, Waterloo (CA); David Lloyd Hobb, Waterloo (CA); Gerard Helmond, Waterloo (CA); Arthur A. Patton, Waterloo (CA); Cuong Quoc Vo, Waterloo (CA); David Watkins, Waterloo (CA)

(73) Assignee: Leggett & Platt Ltd., Waterloo (CA)

( * ) Notice: Subject to any disclaimer, the term of this patent is extended or adjusted under 35 U.S.C. 154(b) by 0 days.

(21) Appl. No.: 10/696,193

(22) Filed: Oct. 29, 2003

(51) Int. Cl.[7] ..... A47C 7/54

(52) U.S. Cl. ..... 297/411.36

(58) Field of Search ..... 248/118.3, 408, 248/409, 157, 423; 297/411.35, 411.36, 411.2, 297/463.1, 411.37, 410, 406, 353, 383

(56) References Cited

U.S. PATENT DOCUMENTS

| | | | | |
|---|---|---|---|---|
| 5,318,347 | A | 6/1994 | Tseng | 297/411.36 |
| 5,997,093 | A * | 12/1999 | Gollin et al. | 297/411.36 |
| 6,062,647 | A * | 5/2000 | Mei | 297/411.36 |
| 6,540,300 | B2 * | 4/2003 | Piretti | 297/411.35 |

* cited by examiner

*Primary Examiner*—Milton Nelson, Jr.
(74) *Attorney, Agent, or Firm*—Shook, Hardy & Bacon, L.L.P.

(57) ABSTRACT

A height-adjustment mechanism may include an integral one-piece leverage body; an integral one-piece sleeve; and a locking member. In an embodiment, the integral one-piece leverage body has a handle, a pair of pivot pins projecting from opposed sides, a tongue projecting rearwardly, and a resilient biasing member projecting forwardly. These parts may be made of low cost materials suitable for integrally forming their features in an injection-moulding operation. Various features built in to these parts may provide a user with a sense of quality.

27 Claims, 5 Drawing Sheets

HEIGHT-ADJUSTMENT MECHANISM FOR AN ARMREST

BACKGROUND OF THE INVENTION

The present invention relates generally to adjustable chairs, and more particularly to a height-adjustment mechanism for an armrest.

Various designs for height-adjustable armrests are known. Some known designs require numerous parts and relatively expensive materials, making such designs less cost competitive. Other known designs include relatively few parts, making them generally less expensive, but such designs may not appear to be of a high quality.

For example, U.S. Pat. No. 5,318,347 issued to Tseng ("Tseng '347") discloses a design for a height-adjustable armrest unit comprising an L-shaped support bar, a vertical sleeve, and a leverage body. In Tseng '347, a tongue provided at a lower end of the leverage body is adapted to engage a positioning hole located on the support bar. The leverage body may be pivoted to disengage the tongue from the positioning hole to allow the sleeve (and the leverage body) to be vertically adjusted relative to the support bar. While Tseng '347 may reduce product cost with fewer parts, the design may not provide a user with a sense that the armrest adjustment mechanism is of a high quality.

Consequently, what is needed is a height-adjustment mechanism for an armrest which can be manufactured at a low cost, yet is long-lasting and capable of giving a user a sense of high quality.

SUMMARY OF THE INVENTION

The present invention provides a height-adjustment mechanism for an armrest. In an embodiment, the height-adjustment mechanism includes an integral one-piece leverage body; an integral one-piece sleeve; and a locking member. These parts may be made of low cost materials suitable for integrally forming their features in an injection-moulding operation. Various features built into these parts may provide a user with a sense of quality.

In an embodiment, the integral one-piece leverage body has a handle, a pair of pivot pins projecting from opposed sides, a tongue projecting rearwardly, and a resilient biasing member projecting forwardly.

The leverage body may be elongate, with the handle located at an upper portion of said body, the tongue located at a lower portion of the body, and the pair of pivot pins located intermediately between the handle and the tongue.

The leverage body may be made of a material suitable for integrally forming the handle, the pivot pins, the tongue and the resilient biasing member in an injection-moulding operation.

The height-adjustment mechanism may further comprise an integral, one-piece sleeve having pivot seats receiving the pivot pins of the leverage body.

The sleeve may be made of a material suitable for forming the pivot seats and the ribs in an injection-moulding operation.

The height-adjustment mechanism may further comprise a support, and a plurality of ribs extending from inner walls of the sleeve to form a channel slidably receiving the support.

The height-adjustment mechanism may further comprise a locking member locking the pivot pins of the leverage body in the pivot seats.

The locking member may be formed of a material suitable for forming the locking member in an injection-moulding operation.

Anti-rattling fingers may be provided to prevent rattling between the various parts of the height-adjustment mechanism.

These and other aspects of the invention will become apparent through the illustrative figures and accompanying description provided below.

BRIEF DESCRIPTION OF THE DRAWINGS

In the figures which illustrate example embodiments of this invention.

DETAILED DESCRIPTION

Figure 1:
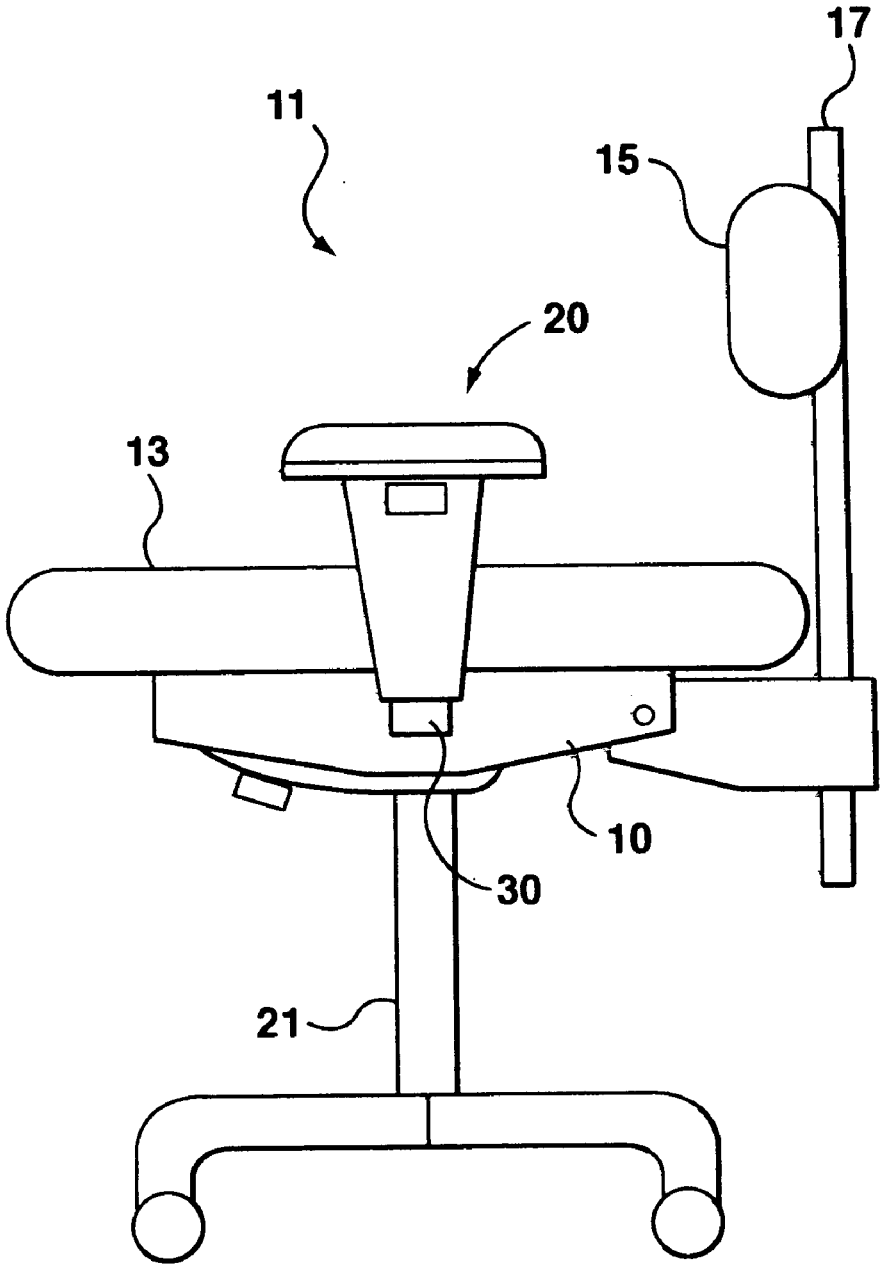
FIG. 1 is a view of an illustrative chair that may embody the invention.

Referring to FIG. 1, shown is an illustrative chair 11 that may embody the present invention. The chair 11 has a chair seat 13 mounted on a chair seat frame 10 and supported by a chair seat support 21. A backrest 15 is supported on a backrest support 17, and the backrest support 17 is mounted on the chair seat frame 10. The chair 11 may further include a pair of armrests, each armrest including a height-adjustment mechanism 20 supported on an armrest support 30.

Figures 2, 8:
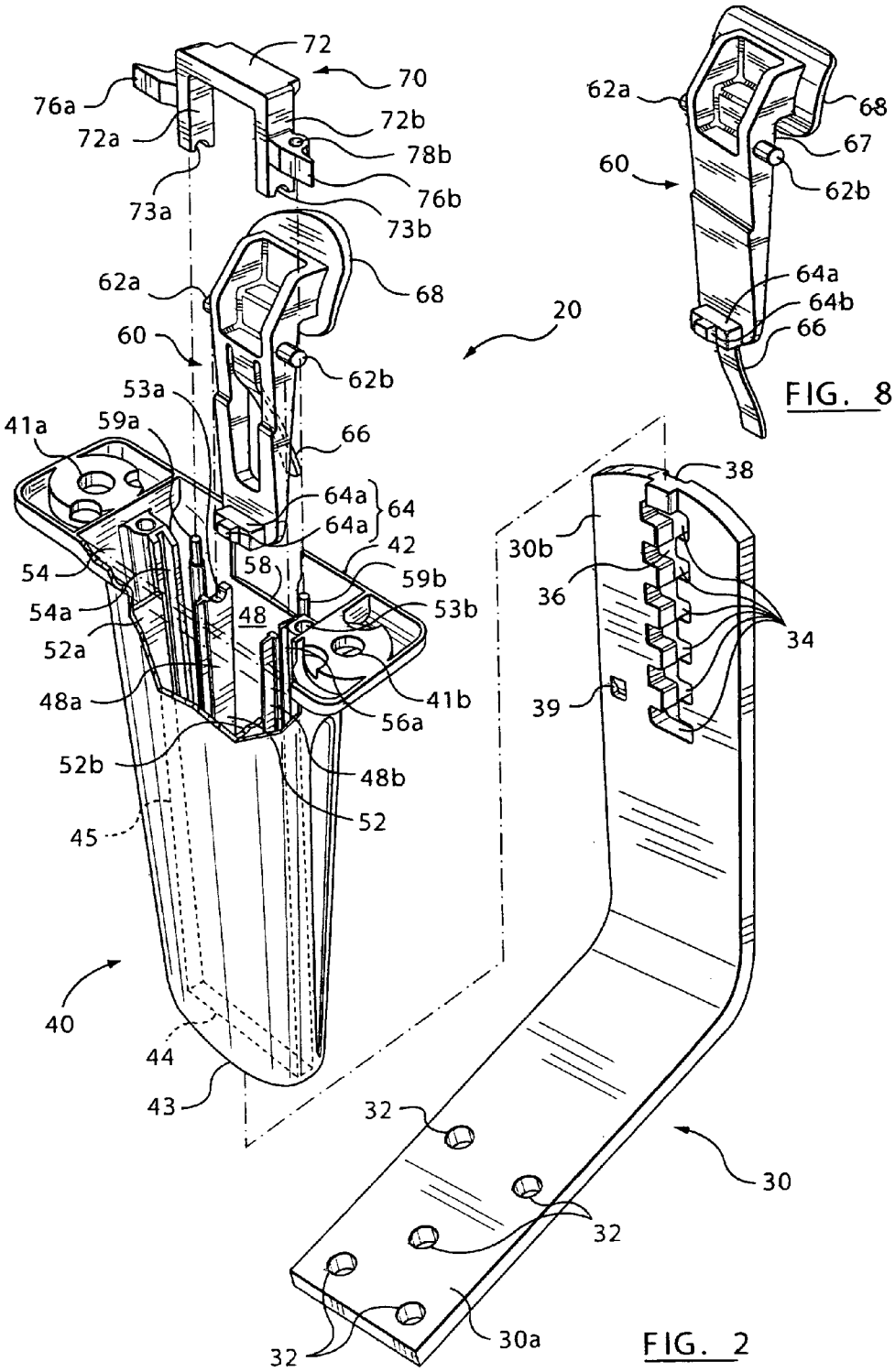
FIG. 2 is an exploded perspective view of a height-adjustment mechanism for an armrest in accordance with an embodiment of the invention.
FIG. 8 is a perspective view of another embodiment of the leverage body of FIG. 2.

FIG. 2 shows an exploded perspective view of a height-adjustment mechanism 20 in accordance with an exemplary embodiment of the invention. As shown, the height-adjustment mechanism 20 may include a sleeve 40, a leverage body 60, and a locking member 70. The sleeve 40, with leverage body 60, are adapted to mount to, and engage, the armrest support 30, as explained below.

In the exemplary embodiment, the support 30 is an L-shaped bar having a first arm 30*a* and a second arm 30*b*. In use, the first arm 30*a* is generally horizontally oriented and may include a plurality of mounting holes 32 for mounting the support 30 to the chair seat frame 10 (using mounting screws, not shown). The generally vertically oriented second arm 30*b* of the support 30 may include a plurality of vertically spaced slots 34. In an embodiment, a vertical groove 36 may join all of the slots 34. As will be explained further below, a protruding tongue 64 formed on a lower portion of the leverage body 60 is adapted to selectively engage one of the slots 34, and the vertical position of the slot 34 engaged by the tongue 64 will determine the vertical position of the height-adjustment mechanism 20.

In order to support the height-adjustment mechanism 20, and the weight placed on the height-adjustment mechanism 20 by an occupant of the chair 11, the support 30 should be made of a sufficiently strong and rigid material. For example, in the exemplary embodiment, an elongate plate made of steel, or another suitable metal, may be used. Other materials such as reinforced plastics and carbon composites may also be used.

Figure 3:
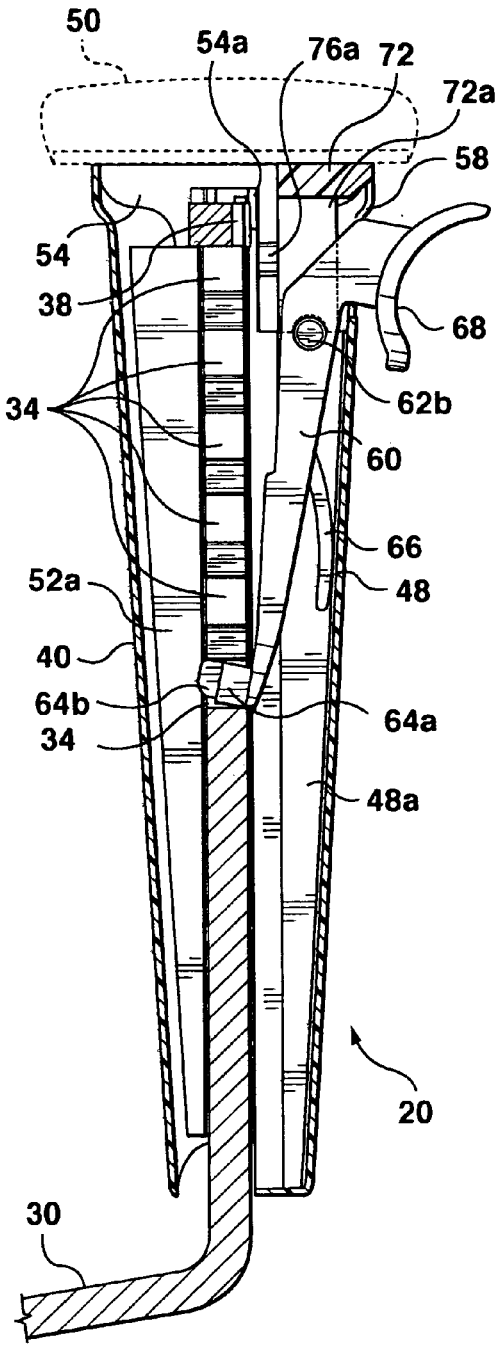
FIG. 3 is a cross sectional side view of the height-adjustment mechanism of FIG. 2 showing the leverage body in a first position.

Still referring to FIG. 2, the sleeve 40 may be formed as an integral, single-piece, injection-moulded structure. For example, the sleeve 40 may be formed of a plastic material that may be injection-moulded in the desired shape. As shown, the sleeve 40 is adapted to be vertically oriented in use and has an upper end 42 and a lower end 43. The lower end 43 of the sleeve 40 has an opening 44 suitably sized to receive the generally vertically oriented second arm 30*b* of the armrest support 30. The upper end 42 of the sleeve 40 is suitably shaped to receive an armrest pad 50 (FIG. 3). Mounting holes 41*a* and 41*b* are provided at the upper end 42 of the sleeve 40 to mount the armrest pad 50 (using mounting screws, not shown).

Still referring to FIG. 2, the sleeve 40 is shown in a partial cutout view with an arrangement of structural reinforcing ribs located on each inside wall of the sleeve 40. A first pair of reinforcing ribs 48*a*, 48*b* is located on a first inside wall 48 of the sleeve 40. A second pair of reinforcing ribs 52*a*, 52*b* is provided on an opposite inside wall 52 of the sleeve 40. Additional reinforcing ribs 54*a* and 56*a* are provided on inner side walls 54 and 56, respectively, which extend between the first and second walls 48 and 52.

Together, the edges of the reinforcing ribs 48*a*, 48*b*, 52*a*, 52*b*, 54*a* and 56*a* form a "channel" 45. As shown, the channel 45 is aligned with opening 44 to slidably receive the vertically oriented second arm 30*b* of the support 30.

Still referring to FIG. 2, a notch 58 is provided at the top of the first wall 48 of the sleeve 40. As shown, the notch 58 is substantially centered between the reinforcing ribs 48*a* and 48*b* and suitably sized to allow a portion of the leverage body 60, namely the handle 68, to extend outside the sleeve 40. A pair of pivot seats 53*a* and 53*b* are provided at the top of the reinforcing ribs 48*a* and 48*b* to position the handle of the leverage body 60 through the notch 58. The leverage body 60 is then free to pivot about the pivot seats 53*a*, 53*b* when the handle 68 is moved by an operator.

In the exemplary embodiment, a pair of mounting posts 59*a* and 59*b* is integrally formed on the sleeve 40 and are located adjacent the pivot seats 53*a*, 53*b*. These mounting posts 59*a*, 59*b* may be used to lock the leverage body 60 in position, using a locking member 70, as described further below.

Still referring to FIG. 2, the leverage body 60 is formed as an integral, single-piece, injection-moulded body. For example, the leverage body 60 may be made of a plastic material injection-moulded into the desired shape. In the exemplary embodiment, the leverage body has a generally elongate body with a pair of pivot pins 62*a*, 62*b* located intermediately along its length. The tongue 64, as mentioned earlier, protrudes from a lower portion of the elongate leverage body 60. Also, a biasing member 66 is integrally formed with the leverage body 60 and extends outwardly in a direction opposite the tongue 64. As mentioned, a handle 68 is provided at an upper end of the leverage body 60. The handle 68 allows an operator to pivot the leverage body 60 about the pivot pins 62*a*, 62*b*. In operation, the biasing member 66 provides a biasing force, acting against the force applied by the operator to the handle 68 of the leverage body 60.

With the integral, one-piece, injection-moulded leverage body 60, advantageously, the most wearable parts—the protruding tongue 64, the pivot pins 62*a*, 62*b*, and the biasing member 66—are all provided on one smaller part which, at the end of its life, may be readily replaced at relatively little cost.

Still referring to FIG. 2, the locking member 70 is preferably formed as an integral, single-piece, injection-moulded body. For example, the locking member 70 may be made of a plastic material that may be injection-moulded into the desired shape. In the exemplary embodiment, the locking member 70 has a frame 72 having first and second arms 72*a*, 72*b*. At the end of each arm 72*a*, 72*b*, first and second pivot caps 73*a*, 73*b* are formed to engage the top of pivot pins 62*a*, 62*b*, when these pivot pins 62*a*, 62*b* are seated in the pivot seats 59*a*, 59*b*. The locking member 70 may further include first and second laterally extending wings 76*a*, 76*b* provided with mounting holes 78*a* and 78*b*, respectively. As shown in FIG. 3, these mounting holes 78*a* and 78*b* may be received by mounting posts 59*a* and 59*b* formed on the sleeve 40 to mount the locking member 70 to the sleeve 40. If the leverage body 60 is placed such that pivot pins 62*c*, 62*b* are received by pivot seats 53*a*, 53*b*, and the locking member 70 is mounted, locking member 70 locks the pivot pins 62*a* and 62*b* in place, while still allowing the leverage body 60 to pivot.

In an embodiment, the locking member 70 may be suitably sized and shaped such that, once mounted, the top of its frame 72 is substantially flush with the top 42 of the sleeve 40. Thus, when an armrest pad 50 is secured to the top of the sleeve 40 (for example by mounting screws mounted through mounting holes 41*a* and 41*b*), the locking member 70 may be held securely in position on the mounting posts 59*a* and 59*b*. The laterally extending wings 76*a*, 76*b* of the locking member 70 may be suitably sized and shaped such that these laterally extending wings 76*a*, 76*b* engage one or more of the reinforcing ribs within the sleeve 40. This may further reinforce the locking member 70 laterally, such that the leverage body 60 is held securely in position.

In another embodiment, once the locking member 70 has been mounted in position on the mounting posts 59*a*, 59*b*, the tip of the mounting posts may be deformed, for example by the application of heat, such that the locking member 70 is locked on the mounting posts 59*a*, 59*b*. This is advantageous where the height-adjustment mechanism 20 may be shipped as a unit prior to its incorporation in a chair. In other circumstances, as the locking member 70 may be kept securely in position by mounting the armrest pad 50, and by lateral reinforcement of the reinforcing ribs, the mounting posts 59*a*, 59*b* may be left as is such that the leverage body 60 may be readily replaced, if necessary.

The height adjustment operation of the height-adjustment mechanism 20 will now be explained.

Referring to FIG. 3, the sleeve 40 is shown mounted on the vertically oriented second arm 30*b* of the armrest support 30. The leverage body 60 is shown with its pivot pins 62*a* and 62*b* seated within the pivot seats 53*a* and 53*b* and secured thereat by the locking member 70.

As shown in FIG. 3, the handle 68 of the leverage body 60 extends through the notch 58 in the first wall 48 of sleeve 40. Within the sleeve 40, the biasing arm 66 of leverage body 60 engages the first wall 48 and biases the leverage body 60 away from the first wall 48. When the leverage body 60 is not actuated by an operator, the biasing force provided by the biasing arm 66 causes the tongue 64 protruding from the lower arm of the leverage body 60 to continuously engage one of the slots 34 in the support 30. As noted earlier, the vertical position of the slot 34 engaged by the tongue 64 determines the vertical height of the height-adjustment mechanism 20.

Figure 4:
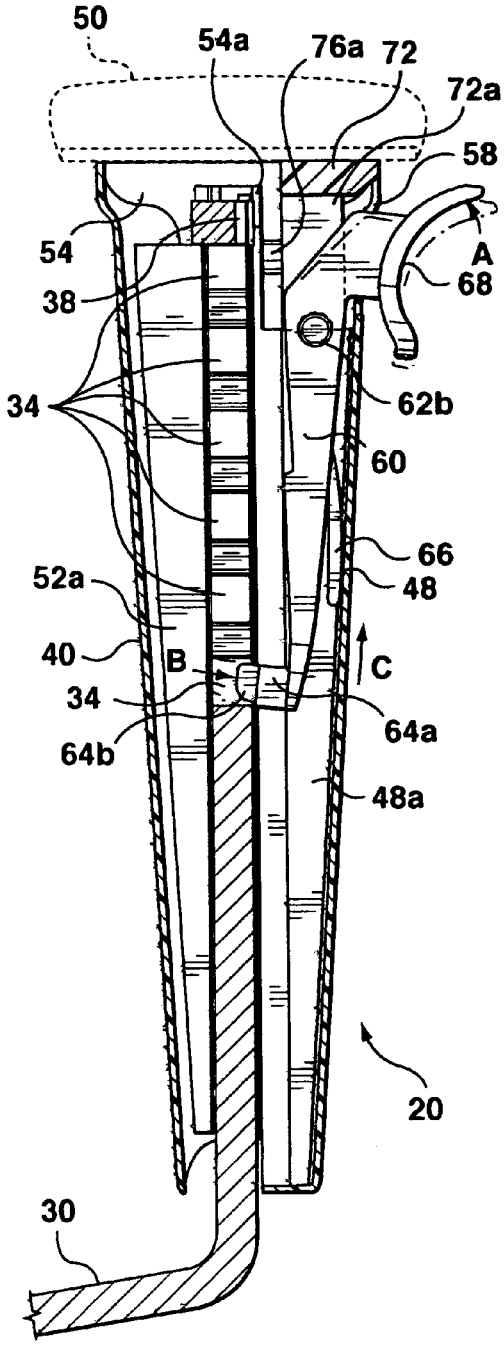
FIG. 4 is the cross sectional side view of FIG. 3 showing the leverage body in a second position.

As shown in FIG. 4, in order to adjust the height of the height-adjustment mechanism 20, the handle 68 of leverage body 60 may be lifted or pulled back by an operator in direction A. This action by the operator will cause the leverage body 60 to pivot about pivot pins 62*a* and 62*b*, against the biasing force of the resiliently flexible biasing arm 66. The biasing arm 66 is resiliently deformed when the handle 68 is lifted by the operator such that the biasing arm 66 will act to reengage the tongue 64 with one of the slots 34 when the handle 68 is released.

In one embodiment, the tongue 64 includes a base 64*a*, and a tip 64*b*. As shown, when the leverage body 60 is pivoted about pivot pins 62*a* and 62*b*, the base 64*a* of the tongue 64 disengages from the slots 34, as shown at B. However, the tip 64*b* of the tongue 64 remains engaged in the vertical groove 36 (FIG. 2). As the vertical groove 36 runs the length of the slots 34, the leverage body 60 and the sleeve 40 may be adjusted vertically, as indicated at C, relative to the support 30. The tongue 64 continuously guides the leverage body 60 within the vertical groove 36, thereby allowing the base 64*a* of tongue 64 to more readily engage any one of the slots 34 when the operator finally releases the handle 68.

In an embodiment, the vertical adjustment of the height-adjustment mechanism 20 by the operator may be limited at an upper and lower limit by the tip 64*b* of the tongue 64 engaging the top and bottom of the slot 36.

Figure 5A:
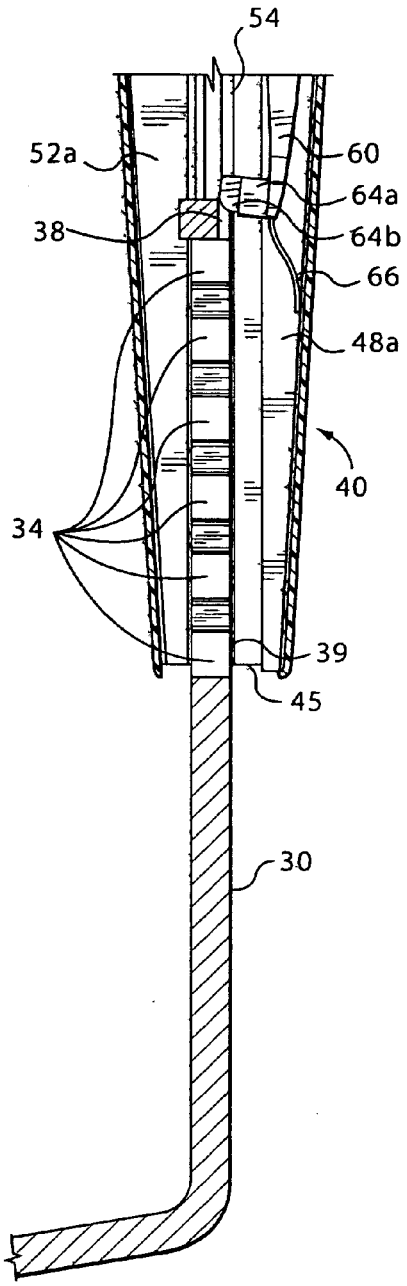
FIG. 5A is a cross sectional side view of a portion of the height-adjustment mechanism of FIG. 2.

Referring to FIG. 5A, in an embodiment, an offset 38 may be formed in the support 30 at the top of the vertical groove 36 to accommodate and guide the tip 64*b* of the tongue 64 of the leverage body 60 when the height-adjustment mechanism 20 is first slidably received on the support 30. When this offset 38 is provided, a separate feature may be provided to limit vertical adjustment of the height-adjustment mechanism 20. For example, a protuberance 39 (seen from the back in FIG. 2) may be formed and suitably located on the vertically oriented second arm 30*b* of the support 30. The protuberance 39 may be ramped in a downward direction such that an inwardly extending part 45 of sleeve 40 will deform and pass over the protuberance 39 on the way down, when the sleeve 40 is first installed, but the inwardly extending part 45 of sleeve 40 will catch on the protuberance 39 on the way up. Thus, the protuberance 39 may prevent the height-adjustment mechanism 20 from being inadvertently lifted clear off the support 30 by the operator.

Figure 5B:
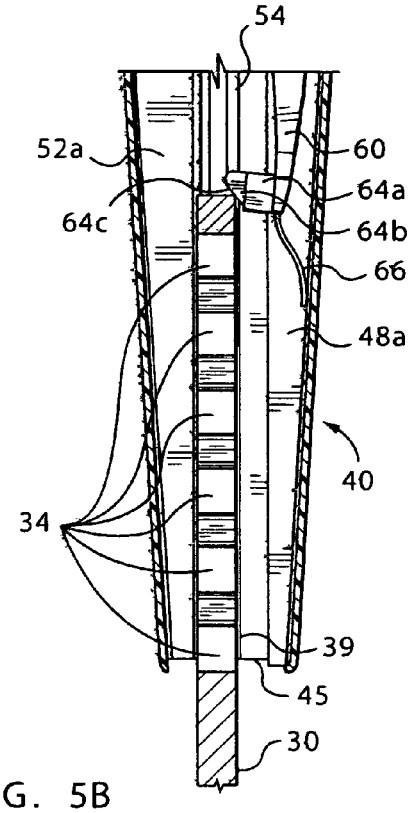
FIG. 5B is a cross sectional view of another embodiment of this invention.

Referring to FIG. 5B, as shown in this alternative embodiment, the offset 38 of FIG. 5A may be absent. In this case, in order to assist in fitting the tip 64*b* of the tongue 64 over the top of the support 30 and into the vertical groove 36 (FIG. 2) during assembly, a ramped surface 64*c* may be provided on the lower portion of the tip 64*b*. As the tip 64*b* otherwise remains the same, the tip 64*b* having the ramped surface 64*c* may continue to engage the vertical groove 36, as described above.

Figure 6:
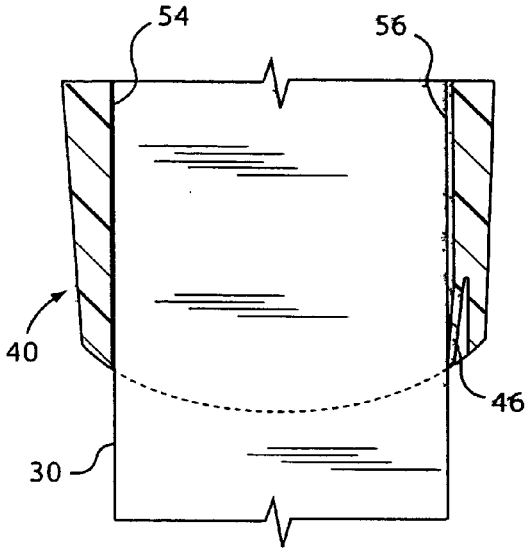
FIG. 6 is a cross sectional front view of a portion of the height-adjustment mechanism of FIG. 2 showing a feature detail of yet another embodiment of the invention.

Referring to FIG. 6, in a further embodiment, a flexibly resilient anti-rattling finger 46 may be formed on one of the inner side walls 54, 56 of the sleeve 40 to flexibly bias the support 30 against the opposite one of the inner side walls 54, 56 of the sleeve 40. In operation, the anti-rattling finger 46 acts to reduce or prevent rattling between the sleeve and the support 30, providing the operator of the height-adjustment mechanism 20 with a more smooth and solid feel.

Figure 7A:
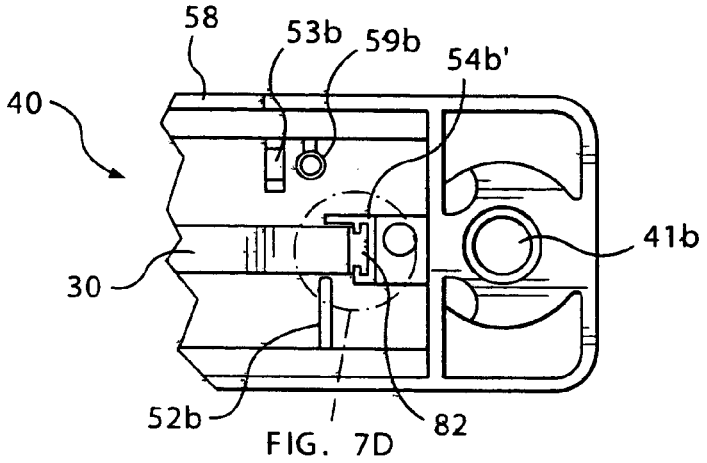
FIGS. 7A–7E are views of a feature detail of yet another embodiment of the invention.
Figure 7B:
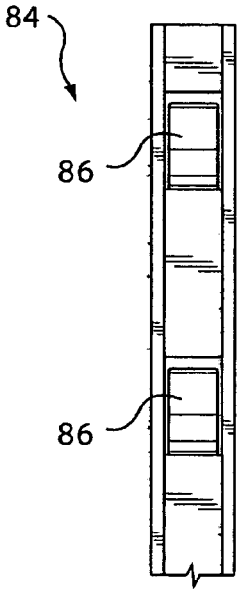
Figure 7C:
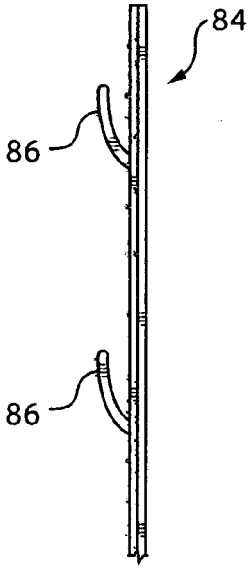
Figure 7D:
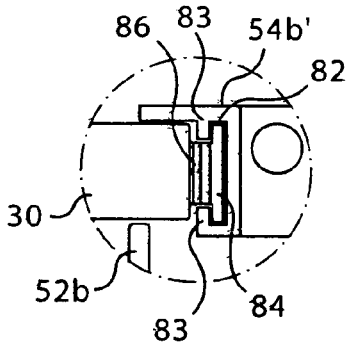
Figure 7E:
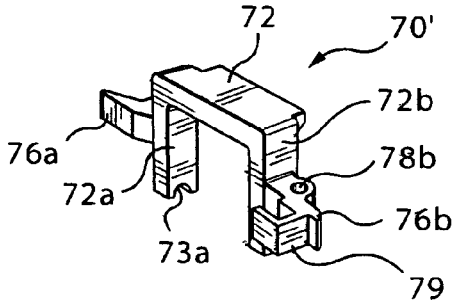

Referring to FIGS. 7A–7E, in a further embodiment, rather than moulding a resilient finger 46 in sleeve 40, the sleeve 40 may be moulded to include a track 82 along a length of a reinforcing rib 54*b*'. As shown in FIG. 7*d*, the track 82 may have retaining walls 83 to retain an insert 84 having a plurality of projecting anti-rattling fingers 86. The anti-rattling fingers 86 extend to abut an edge of the support 30. The anti-rattling fingers 86 are resiliently flexible and may be suitably shaped and sized so they will push the support 30 against the opposite side of the channel 45 (FIG. 2) of sleeve 40 to remove any tolerances between the sleeve 40 and the support 30. In this regard, the insert 84 may be made integrally formed of a resilient plastic material. Advantageously, the anti-rattling fingers 86 may provide a smooth gliding action when the height-adjustment mechanism 20 is adjusted. In order to keep the insert 84 from sliding out of the track 82, a suitable cap may be provided on top of the track 82. For example, as shown in FIG. 7*e*, an extension 79 may provided on the locking member 70 in order to contain the insert 84 within the track 82.

In yet another embodiment, as shown in FIG. 8, an alternative leverage body 60' has a biasing member 66' extending from a bottom end, rather than extending from an intermediate region (as shown at 60 in FIG. 2). It will be apparent that this alternative leverage body 60' is interchangeable with the leverage body 60 of FIG. 2. It will also be apparent that a biasing member may be integrally formed on the leverage body 60 at various other locations, and that such a biasing member may be embodied in various other configurations.

While an exemplary embodiment of the invention has been shown and described, it will be apparent to those skilled in the art that various modifications and alterations may be made. Therefore, the invention is defined in the following claims.

What is claimed is:

1. A height-adjustment mechanism for an armrest, comprising:

an integral one-piece leverage body having a handle, a pair of pivot pins projecting from opposed sides, a tongue projecting rearwardly, and a resilient biasing member projecting forwardly;

an integral, one-piece sleeve having pivot seats receiving said pivot pins of said leverage body, wherein a first wall of said sleeve has a pair of ribs extending therefrom, said pivot seats being formed at a top of said ribs.

2. The height-adjustment mechanism of claim 1 wherein said leverage body is elongate, said handle being located at an upper portion of said body, said tongue being located at a lower portion of said body, and said pair of pivot pins being located intermediately between said handle and said tongue.

3. The height-adjustment mechanism of claim 2 wherein said biasing member is a depending finger.

4. The height-adjustment mechanism of claim 3, wherein said depending finger projects below said tongue.

5. The height-adjustment mechanism of claim 2, wherein said leverage body is made of a material suitable for integrally forming said handle, said pivot pins, said tongue and said resilient biasing member in an injection-moulding operation.

6. The height-adjustment mechanism recited in claim 5, wherein said material is a plastic.

7. The height-adjustment mechanism of claim 1, further comprising a support and wherein a plurality of ribs extending from inner walls of said sleeve form a channel slidably receiving said support.

8. The height-adjustment mechanism of claim 7, wherein said support includes a plurality of spaced slots and receives said tongue of said leverage body in one of said slots, said leverage body being operable by an operator to disengage said tongue from said one of said slots for height-adjustment of said mechanism.

9. The height-adjustment mechanism of claim 8, further including a protuberance provided on said support, said protuberance being suitably positioned to catch an inwardly extending part of said sleeve, such that said leverage body is prevented from completely disengaging from said support.

10. The height-adjustment mechanism of claim 8, wherein said biasing member projects forwardly to engage an inner wall of said sleeve and biases said tongue rearwardly, towards said slots on said support.

11. The height-adjustment mechanism of claim 8, wherein a vertical groove joins all of said slots on said support.

12. The height-adjustment mechanism of claim 11, wherein said tongue of said leverage body includes a base and a tip, and said tip of said tongue is adapted to continuously engage said vertical groove when said base of said tongue is disengaged from said slots during height-adjustment of said mechanism by an operator.

13. The height-adjustment mechanism of claim 12, wherein said tip of said tongue includes a ramped surface on its lower portion to assist, during assembly, in fitting said tip of said tongue over said support and into said vertical groove.

14. The height-adjustment mechanism of claim 7, further including a track on one side of said channel, and an insert with an anti-rattling finger retained in said track, said anti-rattling finger extending to bias said support against another side of said channel in order to reduce rattle.

15. The height-adjustment mechanism of claim 14, further comprising a locking member locking said pivot pins of said leverage body in said pivot seats and containing said insert in said track.

16. The height-adjustment mechanism of claim 7, further including an anti-rattling finger formed on one side of said channel, said anti-rattling finger biasing said support against another side of said channel in order to reduce rattle.

17. The height-adjustment mechanism of claim 7, wherein said sleeve is made of a material suitable for forming said pivot seats and said ribs in an injection-moulding operation.

18. The height-adjustment mechanism of claim 9, wherein said material is a plastic.

19. A height-adjustment mechanism for an armrest, comprising:

an integral one-piece leverage body having a handle, a pair of pivot pins projecting from opposed sides, a tongue projecting rearwardly, and a resilient biasing member projecting forwardly;

wherein said leverage body is elongate, said handle being located at an upper portion of said body, said tongue being located at a lower portion of said body, and said pair of pivot pins being located intermediately between said handle and said tongue;

wherein said biasing member is a depending finger; and wherein said depending finger is located between said pair of pivot pins and said tongue.

20. A height-adjustment mechanism for an armrest, comprising:

an integral one-piece leverage body having a handle, a pair of pivot pins projecting from opposed sides, a tongue projecting rearwardly, and a resilient biasing member projecting forwardly;

a support;

an integral, one-piece sleeve having pivot seats receiving said pivot pins of said leverage body and a plurality of ribs extending from inner walls of said sleeve form a channel slidably receiving said support; and a locking member locking said pivot pins of said leverage body in said pivot seats.

21. The height adjustment mechanism of claim 20, wherein a first wall of said sleeve has a pair of ribs extending therefrom, said pivot seats being formed at a top of said ribs.

22. The height-adjustment mechanism of claim 20, wherein said locking member is suitably sized and shaped such that said locking member engages at least one of said ribs in said sleeve, such that said locking member is secured laterally.

23. The height-adjustment mechanism of claim 20, further comprising mounting holes provided on said locking member, and corresponding mounting posts integrally formed on said sleeve for mounting said locking member thereon.

24. The height-adjustment mechanism of claim 23, wherein a tip of said mounting posts extend above said mounting holes of said locking member, and the tip of said mounting posts are deformed to secure said locking member thereon.

25. The height-adjustment mechanism of claim 23, wherein said locking member is suitably sized and shaped such that the top of said locking member is substantially flush with the top of said sleeve, said locking member being secured in position on said mounting posts by an armrest pad mounted on the top of said sleeve.

26. The height-adjustment mechanism of claim 20, wherein said locking member is formed of a material suitable for forming said locking member in an injection-moulding operation.

27. The height-adjustment mechanism of claim 26, wherein the material is a plastic.

* * * * *